US010934154B2

(12) United States Patent
Hausner et al.

(10) Patent No.: US 10,934,154 B2
(45) Date of Patent: Mar. 2, 2021

(54) DEVICE FOR CONVEYING VISCOUS MATERIAL

(71) Applicant: Atlas Copco IAS GmbH, Bretten (DE)

(72) Inventors: Thomas Hausner, Bretten (DE); Siegmund Oberhofer, Pforzheim (DE); Gerrit Enderle, Knittlingen (DE)

(73) Assignee: Atlas Copco IAS GmbH, Bretten (DE)

( * ) Notice: Subject to any disclaimer, the term of this patent is extended or adjusted under 35 U.S.C. 154(b) by 0 days.

(21) Appl. No.: 16/462,343

(22) PCT Filed: Sep. 14, 2017

(86) PCT No.: PCT/EP2017/073123

§ 371 (c)(1),
(2) Date: May 20, 2019

(87) PCT Pub. No.: WO2018/114068

PCT Pub. Date: Jun. 28, 2018

(65) Prior Publication Data

US 2019/0367352 A1 Dec. 5, 2019

(30) Foreign Application Priority Data

Dec. 21, 2016 (DE) ..... 10 2016 125 207

(51) Int. Cl.

| | |
|---|---|
| ***B67D 7/02*** | (2010.01) |
| ***B05C 11/10*** | (2006.01) |
| ***B67D 7/64*** | (2010.01) |
| ***F04B 15/02*** | (2006.01) |
| ***F04B 23/02*** | (2006.01) |

(52) U.S. Cl.

CPC ..... *B67D 7/0227* (2013.01); *B05C 11/10* (2013.01); *B67D 7/645* (2013.01); *F04B 15/02* (2013.01); *F04B 23/028* (2013.01)

(58) Field of Classification Search

CPC ..... F04B 23/02–028; F04B 15/02; F04B 23/028; F04B 53/16; B67D 7/645;
(Continued)

(56) References Cited

U.S. PATENT DOCUMENTS 2,254,317 A * 9/1941 Roberts ..... B65B 69/005 222/173
2,735,586 A 2/1956 Field
(Continued)

FOREIGN PATENT DOCUMENTS

DE 10 2004 030 654 A1 1/2006
DE 10 2005 049805 A1 2/2007
(Continued)

OTHER PUBLICATIONS

German Search Report in German Application No. 10 2016 125 207.7 dated Aug. 18, 2017 with English translation of relevant parts.
(Continued)

*Primary Examiner* — Paul R Durand
*Assistant Examiner* — Randall A Gruby
(74) *Attorney, Agent, or Firm* — Collard & Roe, P.C.

(57) ABSTRACT

The invention relates to an apparatus (10, 110) for the conveying of viscous material from a drum-like container (12), which has a container bottom (14) and a circumferential container wall (18) extending from the container bottom (14) to an upper rim (16) of the container, which is open at the upper rim (16) of the container, the apparatus having, for closing of the container (12), a follower plate (26) having a material outlet (28) attached to a conveyor pump (30), wherein the follower plate (26) can be moved up and down in the container (12) while being in sealing contact against an inside face of the container wall (18) turned toward it, and having a lifting device (22) for raising and lowering of the follower plate (26), wherein the lifting device (22) has a
(Continued)

Figure 1C:
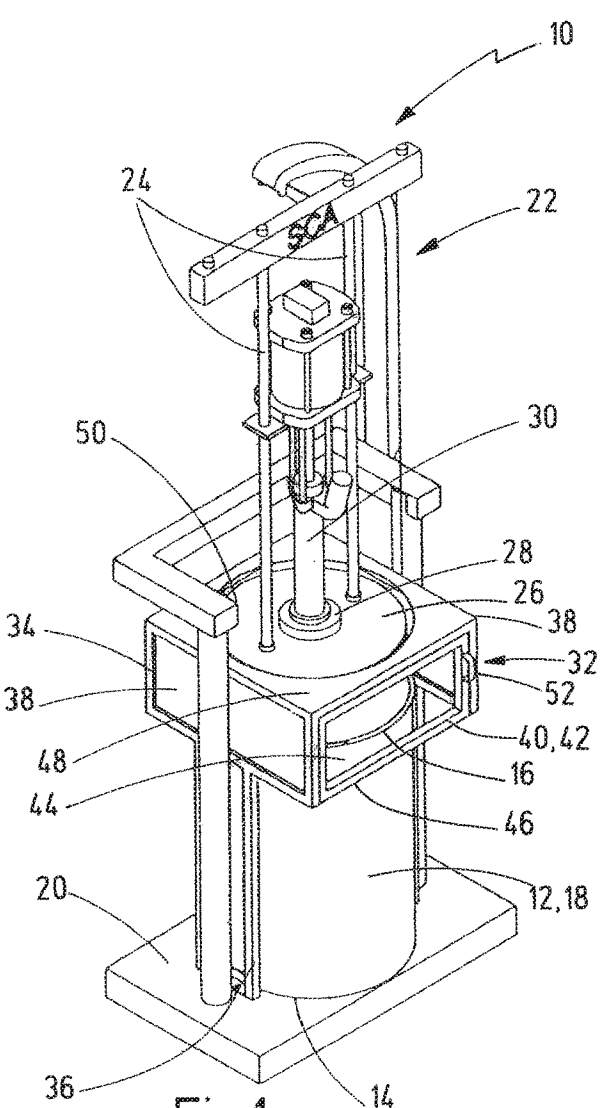

drive unit. According to the invention, a protective device (32, 132) having a protective member (34, 134) is provided, which is disposed in such a way with respect to the follower plate (26) and the container (12) that, upon introduction of the follower plate (26) into the container (12), it annularly surrounds on the one hand the follower plate (26) and on the other hand the container (12) in the region of the upper rim (16) of the container. The protective device (32, 132) additionally has at least one switch (52, 152, 154) for switching-off of the drive unit upon an at least partial exposure of the upper rim (16) of the container by the protective member (34, 134) during the introduction of the follower plate (26) into the container (12).

14 Claims, 4 Drawing Sheets

(58) Field of Classification Search
CPC ..... B67D 7/02; B67D 7/0227; B67D 7/0233; B05C 11/10
See application file for complete search history.

(56) References Cited

U.S. PATENT DOCUMENTS 3,601,285 A * 8/1971 Leger ..... B67D 7/62 222/250
4,635,820 A * 1/1987 Marshall ..... B29B 13/022 187/267
4,651,897 A * 3/1987 Johnson ..... B67D 7/645 222/261
4,978,042 A * 12/1990 Fidler ..... B41F 31/02 222/326
5,318,198 A 6/1994 Micek et al.
6,550,643 B1 * 4/2003 Foster ..... B41F 31/08 222/256
7,762,428 B2 * 7/2010 Scheugenpflug ..... B05C 11/10 222/53
10,011,471 B2 * 7/2018 Krueger ..... B67D 1/125
2008/0023082 A1 1/2008 Schucker
2019/0210865 A1 * 7/2019 Hausner ..... B67D 7/645
2020/0189905 A1 * 6/2020 Scheugenpflug ..... B67D 7/645

FOREIGN PATENT DOCUMENTS

DE 10 2013 103734 A1 10/2014
EP 2 500 108 A1 9/2012

OTHER PUBLICATIONS

International Search Report in PCT/EP2017/073123, dated Dec. 20, 2017.
English translation of International Preliminary Report on Patentability and Written Opinion of the International Searching Authority in PCT/EP2017/073123, dated Jul. 4, 2019.

* cited by examiner

DEVICE FOR CONVEYING VISCOUS MATERIAL

CROSS REFERENCE TO RELATED APPLICATIONS

This application is the National Stage of PCT/EP2017/073123 filed on Sep. 14, 2017, which claims priority under 35 U.S.C. § 119 of German Application No. 10 2016 125 207.7 filed on Dec. 21, 2016, the disclosure of which is incorporated by reference. The international application under PCT article 21(2) was not published in English.

The invention relates to an apparatus for conveying of viscous material according to the preamble of claim 1.

Apparatuses of this type (see, for example, DE 10 2004 030 654 A1) find broad use in particular in motor-vehicle fabrication, in which viscous adhesives, sealing compounds or insulating compounds must be conveyed from a drum to an application station, so that they may be applied on a body component. In the process, the follower plate rests on the surface of the viscous material present in the drum and by means of the lifting device is slaved to the descending material level, until the drum is emptied. Then the lifting device lifts the follower plate out of the drum, so that the empty drum can be replaced by a full drum. For restart of the conveying process, the follower plate must be introduced into the full drum, which is open at the top, until it rests on the surface of the viscous material. This takes place by lowering of the follower plate by means of the lifting device. Since the follower plate must bear sealingly against the inside face of the wall of the drum, the introduction of the follower plate into the drum requires some sensitivity, and so the drum change should be undertaken by trained professionals.

Especially when inexperienced and inadequately trained personnel are used, the danger exists, during introduction of the follower plate into the drum, that workers may suffer bruises if they handle the upper rim of the drum or the follower plate incorrectly.

It is therefore the task of the invention to further develop an apparatus of the type mentioned in the introduction in such a way that the danger of injury to the operator-control personnel is reduced.

This task is accomplished according to the invention by an apparatus having the features of claim 1. Advantageous further developments of the invention are subject matter of the dependent claims.

The invention is based on the idea of enclosing the region in which the danger of injury exists in largely safe manner, so that operator-control personnel cannot handle anything in this region, namely in the region of the upper rim of the container, when the follower plate is introduced into the container. For this purpose, a protective member is provided which, during introduction of the follower plate into the container, annularly surrounds both the follower plate and the container in the region of the upper rim of the container, so that, at the critical moment of the introduction of the follower plate into the container, the upper rim of the container is not exposed at any point, but instead is covered at least radially, so that it is not possible to reach from outside into the container. In addition, at least one switch for switching-off of the drive unit of the lifting device is provided, which is actuated if the upper rim of the container becomes at least partly exposed by removal of the protective member during the introduction of the follower plate into the container. If the protective element is incorrectly removed during the introduction of the follower plate into the container, the switch is actuated and it switches off the drive unit, so that the introduction of the follower plate into the container is stopped and a danger of injury no longer exists.

According to a first exemplary embodiment, the protective member is a downwardly open housing disposed in fixed position, which on a front side has a door, upon the opening of which the at least one switch is actuated. The door is necessary in order that, during the replacement of an emptied container by a full container, the empty container may be pushed out of the housing and the full container pushed into the housing. For this purpose, the door expediently extends upward from a lower rim at the front side of the housing at least to the upper rim of the container. While the door is opened, the drive unit of the lifting device is switched off by means of the switch and a raising or lowering of the follower plate is not possible.

For arrangement of the housing in fixed position, it is preferred that it rest on bracing feet, which in turn may be placed on the same installation surface on which the container is also placed. In addition, the housing may advantageously have a housing cover, preferably reaching beyond the follower plate, so that it is not even possible to grasp the upper rim of the container from above during introduction of the follower plate into the container. The housing cover expediently has an opening through which the conveyor pump and/or supply lines of the conveyor pump and/or retaining means are passed that connect the follower plate to the lifting device. What it decisive in this further development according to the invention is only that the housing cover extends beyond the upper rim of the container and a little further in radial direction toward the follower plate or over the follower plate.

According to a second exemplary embodiment, the protective member is a hood that rests on the follower plate and has a top wall resting on an upper side of the follower plate and an annularly circumferential side wall extending downward from the top wall. The side wall surrounds the follower plate annularly and extends further downward beyond an underside of the follower plate, wherein it is designed for surrounding of the upper rim of the container. Furthermore, at least one first switch for switching-off of the drive unit is disposed in the region between the top wall and the upper side of the follower plate, and is actuated during raising of the hood from the follower plate. Preferably, the at least one first switch is disposed in or on the top wall of the hood. In this exemplary embodiment, the at least one first switch is already actuated when the hood is being raised from the follower plate. In the process, it is not imperative that it must be raised so far that the upper rim of the container is exposed. However, any exposure of the upper rim of the container by the hood during the introduction of the follower plate into the container imperatively requires a raising of the hood from the follower plate, so that the at least one first switch is actuated. Since, in the second exemplary embodiment, the at least partial exposure of the upper rim of the container during the introduction of the follower plate into the container imperatively requires a raising of the hood from the follower plate, in a restriction to the second exemplary embodiment, the feature of the at least partial exposure of the upper rim of the container could be replaced by the feature of raising of the hood from the follower plate.

Preferably, at least one second switch for switching-off of the drive unit is disposed in the region between the side wall and the hood and the container wall, and is actuated during raising of the hood from the container. The at least one second switch is preferably disposed in or on the side wall of the hood. In this connection, it is preferred that the at least one first switch and the at least one second switch are linked to one another by a logical AND and the drive unit is switched off when the or at least one of the first switches and the or at least one of the second switches is actuated. If the follower plate approaches the container even though the side wall of the hood is not surrounding the upper rim of the container, no danger of injury yet exists and the lowering of the follower plate may be continued, since, by virtue of the resting of the hood on the follower plate, the at least one first switch is not actuated. If the hood with its side wall surrounds the upper rim of the container, the at least one second switch is not actuated, and lowering of the follower plate in the container may take place even when the follower plate is subsequently lowered further in the container, in which case the contact with the hood is lost and the at least one first switch is actuated thereby.

In order to be able to detect a removal of the hood from the follower plate or from the upper rim of the container more rapidly and better, preferably several first switches and/or several second switches are provided. In this case, the first switches are linked to one another by a logical OR, just as the second switches are linked to one another by a logical OR. To switch off the drive unit, it is then sufficient when only one of the first switches and one of the second switches is actuated.

In order to be able to position the hood better on the upper rim of the container, the side wall is expediently equipped with several guide ribs protruding radially inward for contact on an outside face of the container wall. Furthermore, it is preferred that the guide ribs respectively have fitting chamfers, in the region of which their height measured in radial direction is reduced toward a lower end, so that the hood is self-centering upon placement on the upper rim of the container.

Figure 2A:
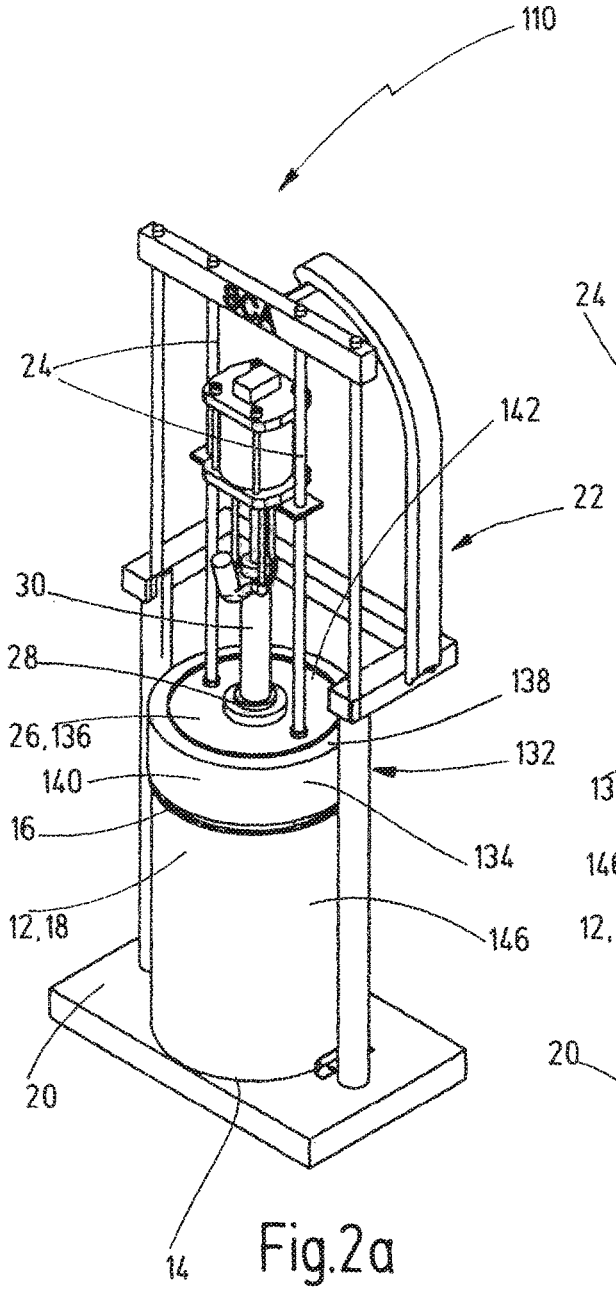
Figure 2B:
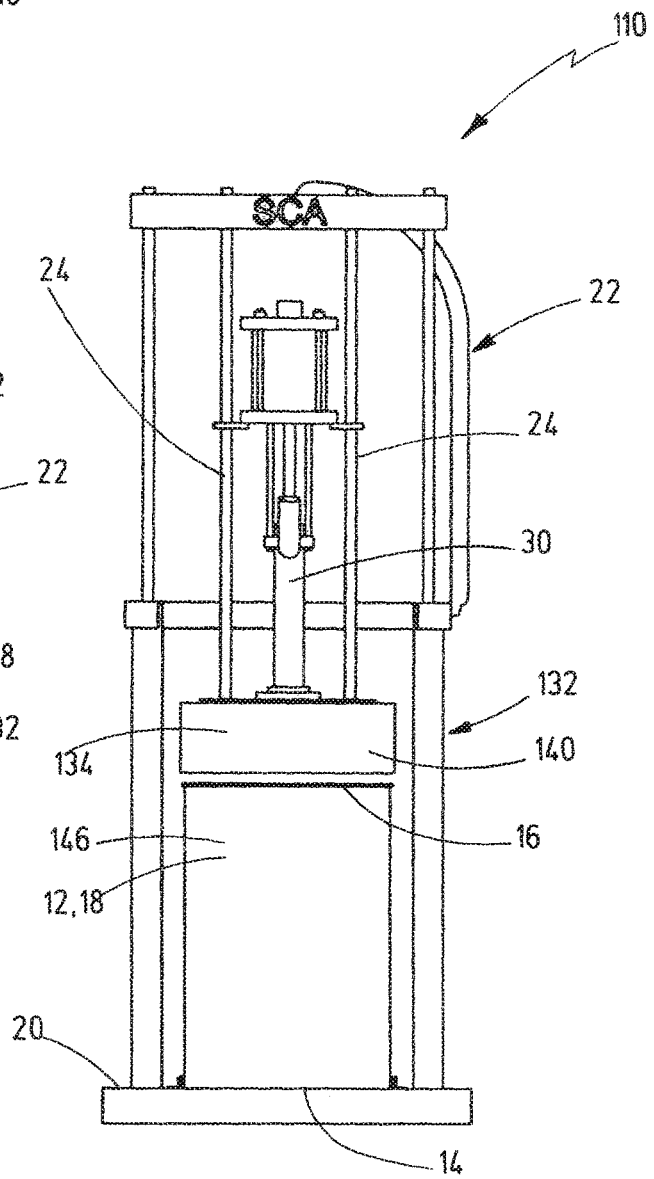
Figure 3A:
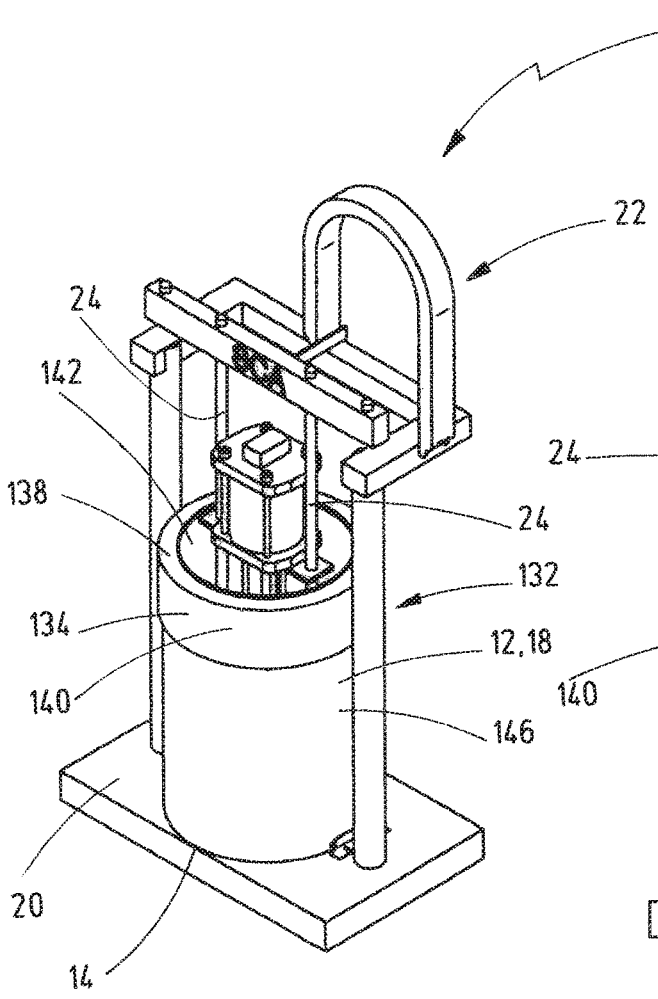
Figure 3B:
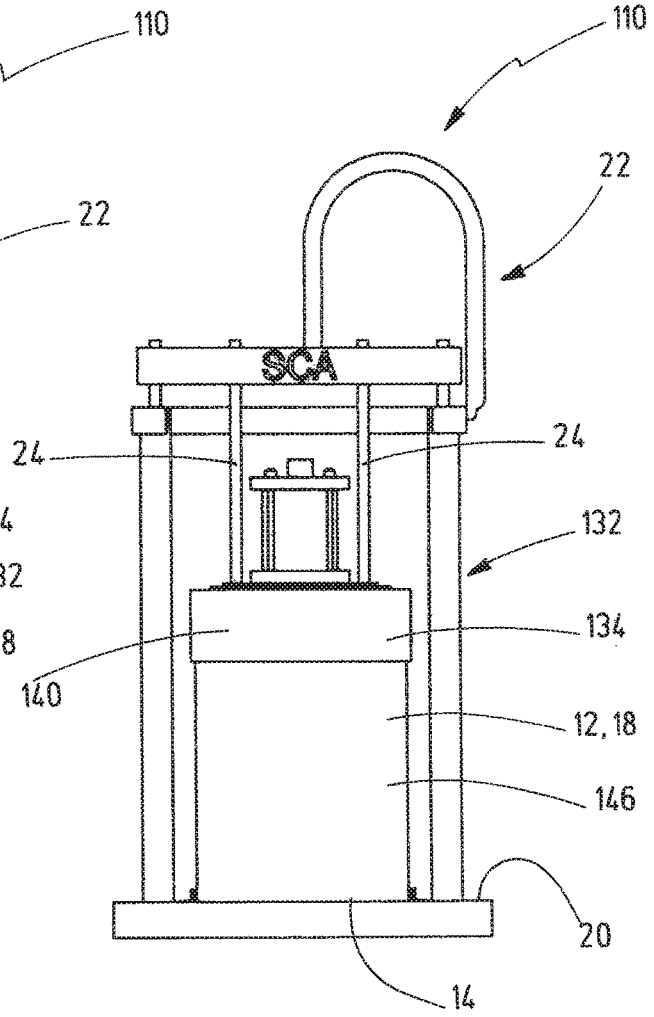
Figure 4:
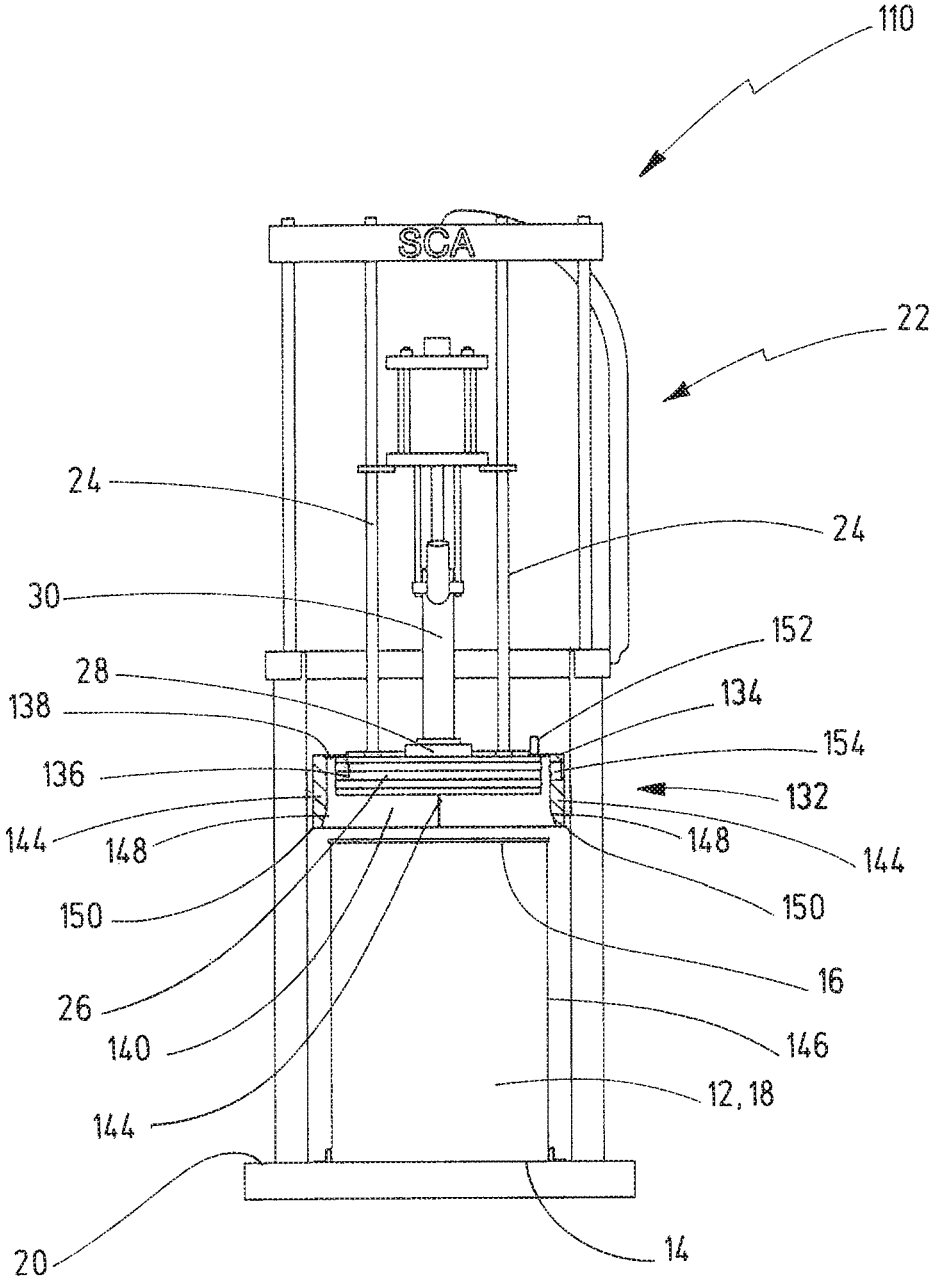

The invention will be explained in more detail in the following on the basis of two exemplary embodiments schematically illustrated in the drawing, wherein FIGS. 1*a, b, c* show an apparatus for conveying of viscous material according to a first exemplary embodiment in two perspective views and one front view;

FIGS. 2*a, b* show an apparatus for conveying of viscous material according to a second exemplary embodiment having a follower plate raised from the container in one perspective view and one front view;

FIGS. 3*a, b* show the apparatus according to FIG. 2*a, b* having a follower plate introduced into the container in one perspective view and one front view and FIG. 4 shows a diagram of the apparatus according to FIG. 2*b* partly in section.

The apparatuses 10, 110 illustrated in the drawing are used for the conveying of viscous material, such as adhesive, sealing compound or insulating compound, for example, from a drum-like container 12, which has a container bottom 14 as well as an annularly circumferential container wall 18 extending upward in the manner of a cylindrical shell from the container bottom 14 to an upper rim 16 of the container, and is open at the upper rim 16 of the container. The apparatuses 10, 110 additionally have a lifting device 22, which is mounted on an installation surface 20 on which the container 12 is also placed, and which has a drive unit—not illustrated in more detail—that may be provided with one or more pneumatic or hydraulic cylinders, one or more spindle drives or one or more electrical linear drives, as well as retaining rods 24, that are movable in vertical direction by means of the drive unit. A follower plate 26, which has a material outlet 28, to which a conveyor pump 30 for the viscous material is connected, is fastened on the retaining rods 24. For conveying of the viscous material, the follower plate 26 is introduced from above into the container 12, until it rests on the surface of the material and bears in annularly sealing manner against the inside face of the container wall 18 turned toward it. As the material level descends, the follower plate is moved downward by means of the drive unit, following the surface of the material, until the container 12 is emptied. Then the follower plate 26 is raised by means of the drive unit until it is pulled out of the container 12 and the container 12 may be replaced by a full container.

In the apparatuses 10, 110 according to the two exemplary embodiments, a protective device 32, 132 is respectively provided, which prevents an operator-control person from reaching in between the follower plate 26 and the upper rim 16 of the container and thereby being able to injure himself/herself during introduction of the follower plate 26 into the container 12. The protective devices 32, 132 will be described in more detail in the following.

Figure 1B:
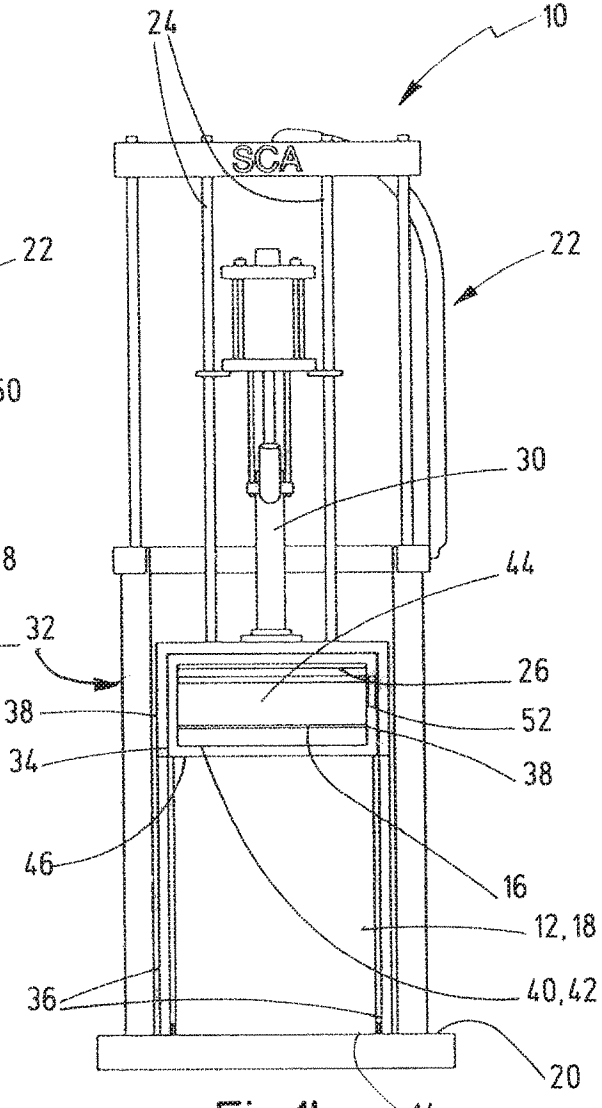
Figure 1A:
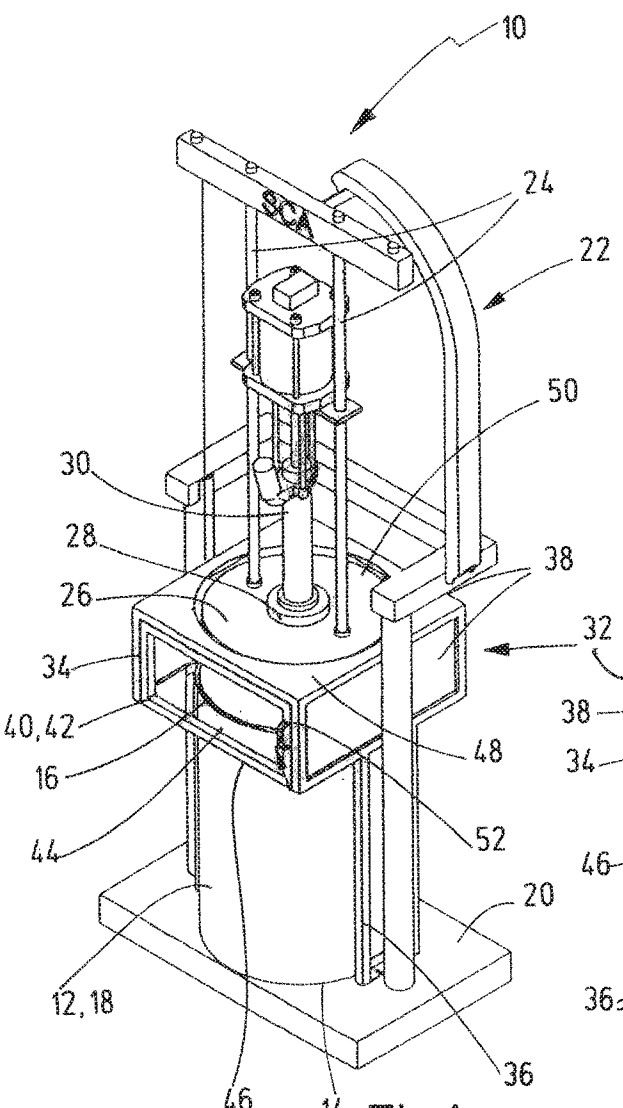

In the first exemplary embodiment illustrated in FIGS. 1*a* to 1*c*, the protective device 32 has a protective member in the form of a rectangular housing 34. The housing 34 is open downward, so that the container 12 is able to project into it from below, and it rests on bracing feet 36, which in turn are fastened on the installation surface 20. The housing 34 is provided on three sides with respectively a side wall 38, while a door 42 having a transparent viewing window 44 of plexiglass, for example, is disposed on a front side 40 in hinged manner on one of the side walls 38. The side walls 38 and the door 42 extend upward, respectively from a lower rim 46 of the housing 34 situated underneath the upper rim 16 of the container, to beyond the upper rim 16 of the container, and in this way surround the upper rim 16 of the container. In this situation, it is also possible that the side walls 38 and the door 42 do not extend downward to the same height. At the top, the housing 34 is partly closed by a housing cover 48, which respectively extends a little further inward from the side walls 38 and the door 42 and in doing so leaves an opening 50 uncovered, from which the conveyor pump 30 and the retaining rods 24 protrude. In the shown exemplary embodiment, the diameter of the opening 50 is approximately as large as the diameter of the follower plate 26. However, it is also possible to make the diameter of the opening 50 smaller than the diameter of the follower plate 26, so that this is covered annularly in a little wider manner by the housing cover 48. A switch 52, which is actuated upon opening of the door 42 and switches off the drive unit, so that a movement of the follower plate 26 is stopped, is disposed in the region of the door 42. A movement of the follower plate 26, and especially an introduction of the follower plate 26 into the container 12, is therefore possible only when the door 42 is closed and the upper rim 16 of the container is annularly surrounded by the housing 34, so that no danger exists of injury by jamming of a body part between the upper rim 16 of the container and the follower plate 26. If the upper rim 16 of the container is partly exposed by opening of the door 42, the movement of the follower plate 26 is stopped.

In the second exemplary embodiment (FIGS. 2*a, b* and FIGS. 3*a, b*), only the protective device 132 is designed differently from the protective device 32 of the first exemplary embodiment. It has a hood 134, which has a top wall 138 resting on an upper side 136 of the follower plate 26, as well as an annularly circumferential side wall 140 extending downward from the top wall 138. The top wall 138 does not cover the follower plate 26 completely, but leaves an opening 142 uncovered through which the conveyor pump 30 and the retaining rods 24 are able to reach. The side wall 140 extends further downward beyond an underside of the follower plate 26 facing away from the upper side 136 and has an inside width such that it is additionally able to surround the container 12 annularly at the upper rim 16 of the container. The inside width is predetermined by four guide ribs 144, which are disposed at equal angular spacings relative to one another and project inwardly from the side wall 140, and which are designed for contact against an outside face 146 turned away from the inside face of the container wall 18. At the bottom, the guide ribs 144 respectively have a fitting chamfer 148, so that the inside width becomes larger downwardly, in that the height of the guide ribs 144 measured in radial direction decreases continuously toward their lower end 150.

As long as the hood 134 rests on the follower plate 26 and its side wall 140 surrounds the follower plate 26 annularly, it is almost impossible to jam a hand between the follower plate 26 and the upper rim 16 of the container during introduction of the follower plate into the container 12. In order to be able to reach into this region, the hood 134 must be raised from the follower plate 26. In order to ensure the safety of the apparatus 110 during introduction of the follower plate 26 into container 12, two first switches 152 for switching-off of the drive unit are disposed on the top wall 138, and are respectively actuated when the hood 134 is raised from the follower plate 26 in the region of the respective first switch 152. Since the upper rim 16 of the container is completely surrounded by the side wall 140 during introduction of the follower plate 26 into the container 12 as long as the hood 134 rests on the follower plate 26, an exposure of the upper rim 16 of the container by raising of the hood 134 necessarily leads to an actuation of at least one of the first switches 152 and thus to a stopping of the movement of the follower plate 26. If the follower plate 26 is received in the container 12 and is following the descending material level, the hood 134 resting on the upper rim 16 of the container is necessarily raised from the follower plate 26. In order to be able to continue the downward movement of the follower plate 26, two second switches 154 are disposed on the side wall 140, and are actuated when the side wall 140 is raised from the upper rim 16 of the container. The drive unit will be stopped only when both at least one of the first switches 152 and at least one of the second switches 154 are actuated simultaneously.

In summary, the following is to be stated: The invention relates to an apparatus 10, 110 for the conveying of viscous material from a drum-like container 12, which has a container bottom 14 and a circumferential container wall 18 extending from the container bottom 14 to an upper rim 16 of the container, which is open at the upper rim 16 of the container, the apparatus having, for closing of the container 12, a follower plate 26 having a material outlet 28 attached to a conveyor pump 30, wherein the follower plate 26 can be moved up and down in the container 12 while being in sealing contact against an inside face of the container wall 18 turned toward it, and having a lifting device 22 for raising and lowering the follower plate 26, wherein the lifting device 22 has a drive unit.

According to the invention, a protective device 32, 132 having a protective member 34, 134 is provided, which is disposed in such a way with respect to the follower plate 26 and the container 12 that, upon introduction of the follower plate 26 into the container 12, it annularly surrounds on the one hand the follower plate 26 and on the other hand the container 12 in the region of the upper rim 16 of the container. The protective device 32, 132 additionally has at least one switch 52, 152, 154 for switching-off of the drive unit upon an at least partial exposure of the upper rim 16 of the container by the protective member 34, 134 during the introduction of the follower plate 26 into the container 12.

Alternatively, the idea of the invention may be formulated in such a way relative to the second exemplary embodiment that, according to the invention, a protective device 132 having a protective member designed as a hood 134 is provided, wherein the hood 134 has a top wall 138 resting on an upper side 136 of the follower plate 26 and an annularly circumferential side wall 140, which extends downward from the top wall 138 and annularly surrounds the follower plate 26, and which extends downward further beyond an underside of the follower plate 26 and is designed to surround the upper rim 16 of the container, and that at least one first switch 152 for switching-off of the drive unit is disposed in the region between the top wall 138 and the upper side 136 of the follower plate 26 and preferably in or on the top wall 138 and is actuated upon raising of the hood 134 from the follower plate 26.

The invention claimed is:

1. An apparatus for the conveying of viscous material from a container (12), which has a container bottom (14) and a circumferential container wall (18) extending from the container bottom (14) to an upper rim (16) of the container, which is open at the upper rim (16) of the container, the apparatus having, for closing of the container (12), a follower plate (26) having a material outlet (28) attached to a conveyor pump (30), wherein the follower plate (26) can be moved up and down in the container (12) while being in sealing contact against an inside face of the container wall (18) turned toward it, and having a lifting device (22) for raising and lowering of the follower plate (26), wherein the lifting device (22) has a drive unit, comprising a protective device (32, 132) having a protective member (34, 134), which is disposed in such a way with respect to the follower plate (26) and the container (12) that, upon introduction of the follower plate (26) into the container (12), it annularly surrounds the follower plate (26) and an upper rim of the container (12), and having at least one switch (52, 152, 154) for switching-off of the drive unit upon the upper rim being at least partially exposed to the ambient environment by the protective member (34, 134) during the introduction of the follower plate (26) into the container (12), wherein the protective member is a downwardly open housing (34) disposed in fixed position, which on a front side (40) has a door (42), upon the opening of which the at least one switch (52) is actuated.

2. The apparatus according to claim 1, wherein the door (42) extends upward from a lower rim (46) at the front side (40) of the housing (34) at least to the upper rim (16) of the container.

3. The apparatus according to claim 1, wherein the housing (34) rests on bracing feet (36).

4. The apparatus according to claim 1, wherein the housing (34) has a housing cover (48) that reaches beyond the follower plate (26).

5. The apparatus according to claim 4, wherein the housing cover (48) has an opening (50) through which the conveyor pump (30) and/or supply lines of the conveyor pump (30) and/or retaining means (24) are passed that connect the follower plate (26) to the lifting device (22).

6. An apparatus for the conveying of viscous material from a container (12), which has a container bottom (14) and a circumferential container wall (18) extending from the container bottom (14) to an upper rim (16) of the container, which is open at the upper rim (16) of the container, the apparatus having, for closing of the container (12), a follower plate (26) having a material outlet (28) attached to a conveyor pump (30), wherein the follower plate (26) can be moved up and down in the container (12) while being in sealing contact against an inside face of the container wall (18) turned toward it, and having a lifting device (22) for raising and lowering of the follower plate (26), wherein the lifting device (22) has a drive unit, comprising a protective device (32, 132) having a protective member (34, 134), which is disposed in such a way with respect to the follower plate (26) and the container (12) that, upon introduction of the follower plate (26) into the container (12), it annularly surrounds the follower plate (26) and an upper rim of the container (12), and having at least one switch (52, 152, 154) for switching-off of the drive unit upon the upper rim being at least partially exposed to the ambient environment by the protective member (34, 134) during the introduction of the follower plate (26) into the container (12), wherein the protective member is a hood (134) resting on the follower plate (26) and having a top wall (138) resting on an upper side (136) of the follower plate (26) and an annularly circumferential side wall (140), which extends downward from the top wall (138) and annularly surrounds the follower plate (26), and which extends downward further beyond an underside of the follower plate (26) and is designed for surrounding of the upper rim (16) of the container, and wherein at least one first switch (152) for switching-off of the drive unit is disposed in a region between the top wall (138) and the upper side (136) of the follower plate (26) and is actuated upon raising of the hood (134) from the follower plate (26).

7. The apparatus according to claim 6, wherein at least one second switch (154) for switching-off of the drive unit is disposed in the region between the side wall (140) and the container wall (18) and preferably in or on the side wall (18) and is actuated during raising of the hood (134) from the container (12).

8. The apparatus according to claim 7, wherein the at least one first switch (152) and the at least one second switch (154) are linked to one another by a control logic AND and the drive unit is switched off when the at least one first switch (152) and the at least one second switch (154) is actuated.

9. The apparatus according to claim 7, wherein several second switches (154) are provided, which are linked to one another by a control logic OR.

10. The apparatus according to claim 6, wherein several first switches (152) are provided, which are linked to one another by a control logic OR.

11. The apparatus according to claim 6, wherein the side wall (140) is equipped with several guide ribs (144) protruding radially inward for contact against an outside face (146) of the container wall (18).

12. The apparatus according to claim 11, wherein the guide ribs (144) respectively have fitting chamfers (148), in the region of which their height measured in radial direction is reduced toward a lower end (150) of the sidewall.

13. A method, using the apparatus (10, 110) according to claim 1, for introduction of a follower plate (26) into a container (12), which has a container bottom (14) and a circumferential container wall (18) extending from the container bottom (14) to an upper rim (16) of the container, which is open at the upper rim (16) of the container, wherein the follower plate (26) is lowered into the container (12) by the lifting device (22), while the follower plate (26) and the upper rim (16) of the container are annularly surrounded by the protective member (34, 134), and wherein the lowering movement is stopped by switching-off of the drive unit when the upper rim (16) of the container is at least partly exposed.

14. A method, using the apparatus (10, 110) according to claim 7, for introduction of a follower plate (26) into a container (12), which has a container bottom (14) and a circumferential container wall (18) extending from the container bottom (14) to an upper rim (16) of the container, which is open at the upper rim (16) of the container, wherein the follower plate (26) is lowered into the container (12) by the lifting device (22), while the follower plate (26) and the upper rim (16) of the container are annularly surrounded by the protective member (34, 134), and wherein the lowering movement is stopped by switching-off of the drive unit when the upper rim (16) of the container is at least partly exposed.

* * * * *